United States Patent [19]

Phillips

[11] 4,092,100

[45] May 30, 1978

[54] DRYING OVEN

[75] Inventor: William A. Phillips, Comstock Park, Mich.

[73] Assignee: Granco Equipment, Inc., Grand Rapids, Mich.

[21] Appl. No.: 724,351

[22] Filed: Sep. 17, 1976

[51] Int. Cl.[2] ..... F23J 15/00

[52] U.S. Cl. ..... 432/72; 165/8; 432/219

[58] Field of Search ..... 432/72, 219, 223; 165/8

[56] References Cited

U.S. PATENT DOCUMENTS

| | | | |
|---|---|---|---|
| 1,476,142 | 12/1923 | Bradshaw | 432/26 |
| 1,590,373 | 6/1926 | Holbeck | 432/179 |
| 2,442,953 | 6/1948 | Krone et al. | 137/326 |
| 3,437,321 | 4/1969 | Wilkinson | 432/72 |
| 3,484,189 | 12/1969 | Hardison et al. | 432/210 |
| 3,706,445 | 12/1972 | Gentry | 34/79 |
| 3,837,794 | 9/1974 | Phillips | 432/18 |
| 3,947,235 | 3/1976 | Bornert | 432/72 |

OTHER PUBLICATIONS

The Industrial Energy Journal, vol. I, issue No. 1, Spring 1975, pp. 1–8.

*Primary Examiner*—John J. Camby
*Attorney, Agent, or Firm*—McGarry & Waters

[57] ABSTRACT

A drying oven for painted surfaces wherein the work is heated and dried by heated, high pressurized air blown against the work as it passes through the oven. A plurality of elongated pipes, each of which have a plurality of nozzle openings therealong, direct the air against the work. The heat of incineration of the solvents stripped from the work is recovered for makeup heated air to the furnace. One or more ceramic rotary heat exchangers are used to transfer the heat from the incineration exhaust gases to the fresh air. Energy required for circulating air through the furnace is minimized by supplying makeup air with a fan to a cold side of the rotary ceramic heat exchanger.

8 Claims, 2 Drawing Figures

DRYING OVEN

BACKGROUND OF THE INVENTION

1. Field of the Invention

This invention relates to industrial heating ovens. In one of its aspects, the invention relates to an industrial drying oven for painted work and the like wherein energy required for circulating air through the furnace is minimized.

2. State of the Prior Art

Recent increases in fuel costs and projected scarcity of fuel have greatly increased the interest in energy conservation in industrial processes. For example, in fume incineration, the heat of incineration has been recovered and used for preheating the fume containing feed to the incinerator. Further, the heat of incineration has been recovered and used to heat these fumes for recycling solvent containing gases to the furnace. See Gentry U.S. Pat. No. 3,706,445 issued Dec. 19, 1972, and Hardison et al U.S. Pat. No. 3,484,189 issued Dec. 16, 1969.

It has recently been suggested to make a rotary generator or heat exchanger wheel from a thermally stable ceramic material sold under the mark CER-VIT® and to use such a regenerator in an industrial incineration process. For example, see Gentry U.S. Pat. No. 3,442,953 issued Mar. 9, 1976. In one prior art system wherein the exhaust from the incinerator is heat exchanged in a ceramic wheel with fume-laden gases from a drying oven as disclosed and claimed in the Gentry U.S. Pat. No. 3,442,953, the exhaust from the heat exchanger has been further heat exchanged with air in metal heat exchange wheels to heat process air for the drying oven.

The heat in the exhaust from an industrial heating furnace is heat exchanged with combustion air in a shell and tube heat exchanger in the disclosure in the U.S. Pat. Nos. to Bradshaw, 1,476,142, issued Dec. 4, 1973, and Hanley Jr., 1,658,332, issued Feb. 7, 1928. The shell and tube heat exchangers are very expensive to construct, are very large and very heavy. Furthermore, these heat exchangers are relatively inefficient in that the heat must pass through thick metal tubes. In Hanley, a fan is provided upstream of the heat exchanger to blow the air therethrough and a second fan is provided on the downstream side of the heat exchanger to draw the exhaust gases therethrough.

In Holbeck U.S. Pat. No. 1,590,373 issued June 29, 1976, recuperation of heat from an open hearth furnace is provided by heat exchanging makeup air for combustion with the exhaust gases from the furnace. Rotating metal discs are provided for this purpose.

In the U.S. Pat. No. 3,837,794 to Phillips issued Sept. 24, 1974, there is disclosed and claimed a billet heating furnace having a plurality of turbulating pipes in a preheating zone. The turbulating pipes are supplied with the air under pressure and have a plurality of jet nozzle openings therealong to uniformly direct the gases against the articles throughout the length of the preheating section to increase the heat transferability of the heated gases in the preheat section of the furnace.

SUMMARY OF THE INVENTION

According to the invention, a drying oven has an elongated chamber through which articles having solvent containing coatings may pass from an entrance end to an exit end. Means are provided for withdrawing the solvent-laden gases from the chamber and means are provided for supplying heated makeup air to the elongated chamber for drying the articles as they pass therethrough. An incinerator for oxidizing the solvent in the solvent laden gases is connected to the solvent-laden gas withdrawing means to oxidize the solvents therein.

According to the invention, the exhaust from the incinerator is heat exchanged with makeup air for the furnace in a heat exchanger, preferably a rotary ceramic, wheel, to recover the heat of incineration. Further, a fan is provided on the cold side of the heat exchanger for supplying cooler air under pressure to the heat exchanger so that the energy of the heated makeup air is derived in part from the heat of the exhaust gases and in part from the cold fan pressure.

Further, according to the invention, the heated makeup air supply means comprises a plurality of jet nozzles which are positioned uniformly along at least a portion of the elongated chamber such that the work passing therethrough is uniformly contacted by heated pressurized air. Desirably, the jet nozzles are positioned above and below the work in the elongated chamber.

Further, a second heat exchanger, preferably a rotary ceramic wheel, is provided for recovering additional heat from the incineration and is connected with the exhaust from the first heat exchanger. Pressurized air is supplied by a fan, for example, to the second heat exchanger and, subsequent to heating therein, is supplied to the furnace as additional heated makeup process air.

An exhaust fan at the cool side of the second heat exchanger draws the heated process air desirably through both the first and second heat exchangers.

BRIEF DESCRIPTION OF THE DRAWINGS

The invention will now be described with reference to the accompanying drawings in which.

DESCRIPTION OF THE PREFERRED EMBODIMENT

Figure 1:
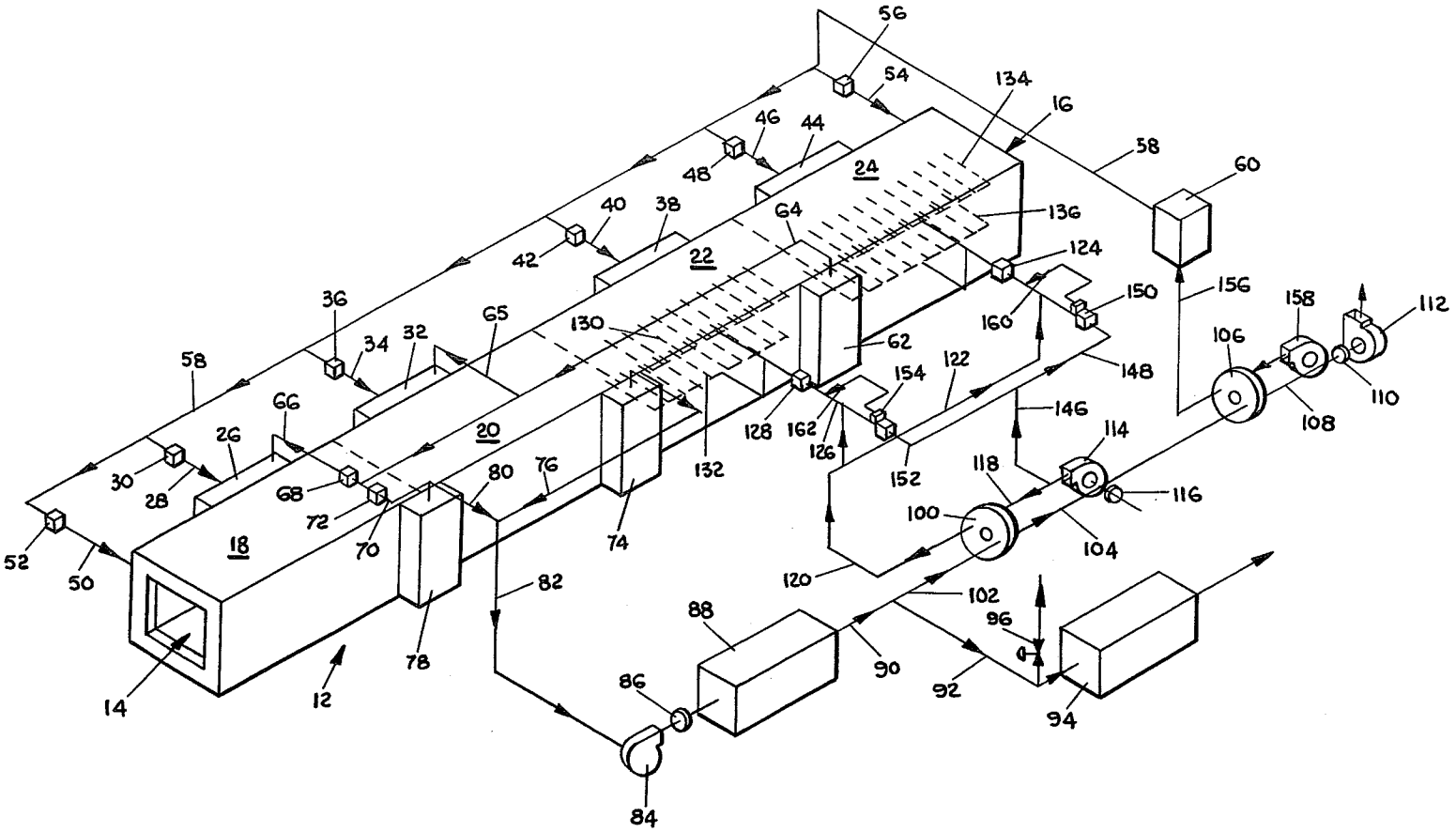
FIG. 1 is a schematic perspective illustration of a drying oven and air supply sustem according to the invention.

Referring now to the drawings, and to FIG. 1 in particular, there is shown a paint-drying oven 12 having an entrance end 14 and an exit end 16. The drying oven 12 comprises a first zone 18, a second zone. 20, a third zone 22 and a fourth zone 24. Recirculating fans 26, 32, 38 and 44 are provided in the four zones to circulate the air in a conventional manner. A supply line 28 having a control valve 30 supplies the air to recirculating fan 26. In like manner, supply lines 34, 40 and 46 having control valves 36, 42 and 48, respectively, supply the air to recirculating fans 32, 38 and 44, respectively. A hot air seal is provided in conventional fashion at the entrance end 14 of the drying oven by means of line 50 which has control valve 52 to control the flow of air therethrough. In like manner, a hot air seal is provided in conventional fashion at the exit end 16 of the oven 12 by means of a supply pipe 54 which has a control valve 56 to control the air flow therethrough. A header pipe 58 which is conventionally connected to a duct burner 60 supplies heated air to the supply lines 28, 34, 40, 46, 50 and 54.

The exhaust system for the drying oven comprises exhaust housings 62, 74 and 78, all of which are in communication with the interior of the drying oven along the length thereof. Exhaust conduit 64 removes the fume laden exhaust gases from the exhaust housing 62 and passes these gases to branch lines 66 and 70 having control valves 68 and 72 respectively. Branch line 66 is connected to recirculating fan 26 to recirculate a portion of the exhaust gases to the furnace. In like manner, a portion of the exhaust gases in line 64 is passed to the recirculating fan 32 through branch line 65.

Exhaust conduit 76 removes the fume laden gases from exhaust housing 74 and combines them with the gases in branch line 70 and in conduit 80, the latter of which removes gases from the exhaust housing 78. A fan 84 draws the fume laden exhaust gases through line 82 and passes them through a flow controller valve 86 to an incinerator 88 wherein the gases are raised to an incineration temperature and are incinerated. The incinerated gases are removed from the incinerator 88 through line 90, line 92 and passed to a boiler 94 wherein they are used for heating water for steam. Alternately, the gases can be exhausted through a pressure operated valve in a vent line 96.

The foregoing has been a description of a conventional paint-drying oven which uses recirculating fans 26, 32, 38 and 44 to circulate heated air through the drying oven 12. The fume laden gases are removed and incinerated.

According to the invention, the flow of gases through the furnace is greatly facilitated at less horsepower while recovering the heat of incineration so that additional heat is not required except conceivably during start-up of the operation. According to the invention, a first ceramic heat exchange wheel 100 is provided to at least partially recover the heat of incineration from incinerator 88. Normally, the incinerator 88 will operate with minimum piloting fuel due to the fact that the solvents in the fume laden gases are sufficient to raise the temperature of the exhaust gases to a temperature high enough so that all of the hydrocarbons and any other oxidizable gases are incinerated. An intake conduit 102 is connected to the conduit 90 to pass the heated gases to a hot side of the first ceramic heat exchanger wheel 100. The cooler gases are removed from the cold side of the heat exchanger wheel 100 through exhaust conduit 104 and passed to a cold side of the second ceramic heat exchanger wheel 106. Line 108 is in communication with line 104 through the second heat exchanger wheel 106 and passes the heat stripped gases to the intake side of a fan 112 through a flow controller valve 110. The fan 112 thus draws the gases through lines 108, 104 and 102 and through the heat exchanger wheels 100 and 106.

An intake fan 114 draws in air from the atmosphere through a flow control valve 116 and passes the gas through a conduit 118 to a cold side of the first ceramic heat exchanger wheel 100. Conduit 120 is in communication with the line 118 through the heat exchanger wheel 100 and passes the heated gases through line 122, valve 124 and two sets of jet pipes 134 and 136 in the fourth zone 24 of the drying oven 12. The heated gases are also passed through line 126, valve 128 to sets of jet pipes 130 and 132 in the third zone 22 of the drying oven 12. The sets of jet pipes 130 and 134 are positioned above the work in the drying oven and are arranged so as to direct the heated air at high velocities onto the top surface of the work passing through the furnace. In similar manner, the sets of jet pipes 132 and 136 are positioned beneath the work in the furnace and are adapted to direct the heated air upwardly onto the work passing through the drying oven.

Figure 2:
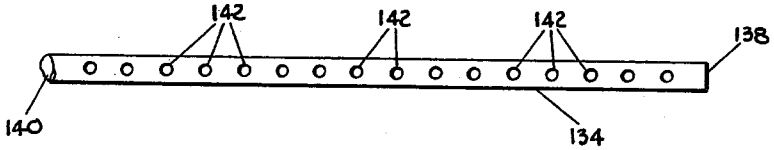
FIG. 2 is a plan view of a jet pipe used in the drying oven illustrated in FIG. 1.

Reference is now made to FIG. 2 for a description of the jet pipes. A jet pipe 134 is illustrated but all of the jet pipes are preferably identical. The jet pipes 134 are elongated in shape and have a closed end 138 and an open end 140. The pipes 134 are hollow and contain a plurality of nozzle openings 142 spaced evenly along the length thereof. The nozzle openings are sized so as to serve as nozzles for the air to discharge the air under pressure in narrow jets from the pipe. The jet pipes thus turbulate the gases significantly in the furnace and direct the gases onto the work under high pressure. Typically, the air will be circulated throughout the system with a pressure drop of one to one and one-half pounds. The pressure drop across the jet pipes 130, 132, 134, and 136 are typically about three-quarters to one pound.

Referring now again to FIG. 1, a conduit 146 connects the line 118 to branch lines 148 and 152 to mix the cooler air as desired with the air in lines 122 and 126 respectively. To this end, a temperature control valve 150 in line 148 and a temperature control valve 154 in line 152 control the flow of gases to the lines 122 and 126 respectively. Temperature control valve 150 is operated responsive to the temperature sensed by temperature sensor 160 in line 122 downstream from line 148. Similarly temperature sensor 162 in line 126 detects the temperature of the air in line 162 and applies a signal representative of the same to the temperature controller 154. When the temperature of the gases in lines 122 and 126 is greater than a predetermined value, then valves 150 and 154 will open more to permit additional cooler air to be admixed with the hotter gases so as to maintain the temperature of the gases entering the furnace through the jet pipes at a predetermined temperature. Adjustment of the gas temperature is necessary, for example, during idling time when significant additional heat is not required by the oven.

An intake fan 158 provides air from the atmosphere to the cold side of the second heat exchanger wheel 106. A line 156 withdraws the heated air from the hot side of heat exchanger wheel 106 and passes that gas to supply pipe 58 through trim burner 60. Normally, in the use of the invention, the trim burner 60 is not needed except occasionally during start-up of the furnace.

The ceramic heat exchanger wheels 100 and 106 are known ceramic heat exchanger wheels. The wheels can have annular gap seals as disclosed and claimed in the U.S. Pat. to Gentry, No. 3,942,953, issued Mar. 9, 1976. The wheels can further be mounted in a manner disclosed and claimed in the U.S. Pat. No. 3,978,913 to Phillips, issued Sept. 7, 1976.

The use of the cold air fan 114, the heat exchanger wheel 100 and the jet pipes 130, 132, 134 and 136 provides an extremely efficient system for operating the drying oven. As indicated above, there is normally sufficient solvent in the exhaust gases to fire the incinerator. The heat from the incinerator is used to supply heat to the gases required for the drying process. Thus, the system runs entirely on the heat of the solvent and avoids the necessity of burning fuel to conduct the drying process. Further, the invention increases the drying ability of the furnace or eliminates the need for recirculating fans in the furnace.

Although the invention has been shown in connection with a drying oven having circulating fans 26, 32, 38 and 44 as would be the case in the event that the invention was added to an existing conventional furnace, the recirculating fans are not necessary and not a part of this invention. In the case of new furnaces, the recirculating fans and the existing piping thereto could by completely eliminated. In such a case, each section of the oven would have one or more sets of jet pipes. In the case where the recirculating fans in the oven are eliminated, the heat transfer takes place at significantly lower energy levels for the same effective drying capacity. The cold fan 114 is in effect used in lieu of the hot internal recirculating fans. The air horsepower required to circulate a given volume of air is dependent on the pressure drop through the system. Since a volume of air is directly proportional to absolute temperature of the air, the use of a fan on the atmospheric temperature gases requires less horsepower for the same amount of air circulation as would be required for circulating the hotter gases. The use of the jet pipes and the ceramic heat exchanger makes it possible to use the fan on the atmospheric temperature gases. Further, the required pressure drop across the jet pipes is very hard to obtain with a fan downstream of the heat exchangers. The jet pipes provide very effective drying and heat transfer. The ceramic heat exchangers are very effective heat recouperators and operate with a relatively low pressure drop so that the pressure drop across the jet pipes is maximized.

In the case where the recirculating fans are eliminated, the heated gases in line 156 would be connected directly to line 146 or could be connected to a space heating plenum for heating an area outside the furnace. Thus, recovery of substantially all of the heat of incineration is possible with the invention.

It has been calculated for a drying oven as described above without a hot circulating fan that the horsepower required to effectively transfer the same amount of heat within the furnace is actually about 40% of the amount of horsepower required for circulation with the recirculating fans in the oven. Further, with the invention, the need for additional energy for the drying process has been eliminated. In addition, the need for multiple, more expensive, hot recirculating fans can be avoided with one or two cold fan blowers as illustrated above.

Reasonable variation and modification are possible within the scope of the foregoing disclosure, the drawings and appended claims without departing from the spirit of the invention.

The embodiments of the invention in which an exclusive property or privilege is claimed are defined as follows:

1. In a drying oven having an elongated chamber through which articles having solvent containing coatings may pass from an entrance to an exit end;

means for withdrawing solvent laden gases from the chamber;

means for supplying heated makeup air to the elongated chamber for drying the articles as they pass therethrough;

an incinerator having an inlet and an outlet for oxidizing solvents in a solvent containing gas;

means for passing solvent laden gases from the withdrawing means and to the incinerator inlet for oxidizing the solvents in the oven exhaust gases;

means for heat exchanging the incinerator effluent with the makeup air for heating the makeup air;

the improvement which comprises:

the heat exchange means includes a rotary ceramic heat exchanger wheel having a hot side and a cold side, first conduit means in communication with the hot side of the ceramic heat exchanger wheel and the incinerator outlet, and second conduit means in communication with the hot side of the ceramic heat exchanger wheel and the elongated chamber heated air supply means;

the heated makeup air supply means comprises a plurality of elongated pipes in communication with the second conduit means, each of which elongated pipes has a plurality of jet nozzles, the jet nozzles being positioned uniformly along at least a portion of the elongated chamber to direct high pressure air streams uniformly against the work as it passes therethrough such that the work is unifomly contacted by heated pressurized air; and further comprising means in communication with the second conduit means through the heat exchanger for supplying superatmospheric pressure air to the cold side of the ceramic heat exchanger wheel and thereby supplying heated air under pressure to the elongated chamber;

whereby the heat supplied to the elongated chamber is derived from the heat of the exhaust gases and the pressure of the heated makeup air is derived in part from the pressure air supply means and in part from the thermal energy obtained from the ceramic heat exchanger wheel; and means in communication with the first conduit means through the ceramic heat exchanger wheel for drawing heated gases from the first conduit means through the ceramic heat exchanger wheel.

2. A drying oven according to claim 1 wherein the jet nozzles are positioned above and below the work as the work passes through the elongated chamber.

3. A drying oven according to claim 2 and further comprising:

a second rotary ceramic heat exchanger wheel having a cold side and a hot side;

the drawing means includes a third conduit means in communication with the hot side of the second ceramic heat exchanger wheel and the cold side of the first heat exchanger wheel;

second means for supplying superatmospheric pressure air to the cold side of the second heat exchanger wheel; and fourth conduit means in communication with the second pressurized air supply means through the second ceramic heat exchanger wheel for supplying heated air to the elongated chamber to provide additional heated air to the oven for drying purposes.

4. A drying oven according to claim 3 wherein the drawing means further comprises means, at the cold side of the second heat exchanger wheel, in communication with the third conduit means through the second ceramic heat exchanger wheel for drawing gases through the second heat exchanger wheel from the third conduit means.

5. A drying oven according to claim 4 and further comprising a bypass conduit between the pressure air supply means and the second conduit means for bypassing the first rotary ceramic heat exchanger wheel; and means to control the flow of air through the bypass conduit so as to maintain the temperature of the air at the heated makeup air supply means below a predetermined value.

6. A drying oven according to claim 1 and further comprising:

a second rotary ceramic heat exchanger wheel having a cold side and a hot side;

the drawing means includes a third conduit means in communication with the hot side of the second ceramic heat exchanger wheel and the cold side of the first heat exchanger wheel;

second means for supplying superatmospheric pressurized air to the cold side of the second heat exchanger wheel; and fourth conduit means in communication with the second pressurized air supply means through the second ceramic heat exchanger wheel for supplying heated air to the elongated chamber to provide additional heated air to the oven for drying purposes.

7. A drying oven according to claim 6 wherein the drawing means further comprises means in communication with the third conduit through the second ceramic heat exchanger wheel for drawing heat stripped gases through the second heat exchanger wheel from the third conduit means.

8. In a drying oven having:

an elongated chamber through which articles having solvent containing coatings may pass from an entrance end to an exit end;

means for withdrawing solvent-laden gases from the chamber;

means for supplying heated makeup air to the elongated chamber for drying articles as they pass therethrough;

an incinerator having an inlet and an outlet for oxidizing solvents in the solvent-laden gases;

means for passing the solvent-laden gases from the withdrawing means to the incinerator inlet for oxidizing the solvent in the oven exhaust gases;

means for heat exchanging the heated exhaust from the incinerator with air;

the improvement which comprises:

means for supplying air under pressure to said heat exchange means;

means for passing air, thus heat exchanged by the heat exchanger, to the heated air supply means for the elongated chamber; and the makeup air supply means including a nozzle means positioned uniformly along at least a portion of the elongated chamber to direct high pressure air streams against the work such that the work passing therethrough is uniformly contacted by heated, pressurized air, the nozzle means being formed from elongated pipes which extend across the elongated chamber, each of the elongated pipes having a plurality of jet nozzle openings along the length thereof for directing heated air against the work as it passes through the elongated chamber.

* * * * *